US005143412A

United States Patent [19]

Lindqvist

[11] Patent Number: 5,143,412

[45] Date of Patent: Sep. 1, 1992

[54] LOCKING MECHANISM FOR SLIDING WINDOWS AND DOORS

[75] Inventor: Per-Olof Lindqvist, Onsala, Sweden

[73] Assignee: Fixfabriken AB, Sweden

[21] Appl. No.: 654,306

[22] Filed: Feb. 12, 1991

[51] Int. Cl.[5] ..... E05C 3/04

[52] U.S. Cl. ..... 292/200; 292/241; 292/DIG. 47

[58] Field of Search ..... 292/DIG. 46, DIG. 47, 292/DIG. 20, DIG. 21, 100, 200, 341.18, 341.19, 66, 240, 241

[56] References Cited

U.S. PATENT DOCUMENTS

| | | | |
|---|---|---|---|
| 448,651 | 3/1891 | Hix | 292/241 |
| 610,739 | 9/1898 | Greene | 292/240 |
| 633,552 | 9/1899 | Kenny | 292/241 |
| 661,404 | 11/1900 | Hubbard | 292/241 |
| 963,983 | 7/1910 | Bernhard | 292/241 |
| 2,128,405 | 8/1938 | Eastman | 292/240 |
| 2,627,435 | 2/1953 | Borrup | 292/DIG. 20 |
| 2,716,262 | 8/1955 | Oswald | 292/240 |
| 3,306,644 | 2/1967 | Larsen | 292/DIG. 47 |
| 3,469,877 | 9/1969 | Hutchison | 292/341.18 |
| 3,599,452 | 8/1971 | Yokohama | 292/241 |
| 3,600,019 | 8/1971 | Toyota | 292/241 |
| 3,785,684 | 1/1974 | Nakanishi | 292/241 |
| 3,811,718 | 5/1974 | Bates | 292/DIG. 38 |
| 4,095,829 | 7/1978 | Van Klompenburg | 292/241 |
| 4,253,688 | 3/1981 | Hosooka | 292/DIG. 46 |

FOREIGN PATENT DOCUMENTS

| | | | |
|---|---|---|---|
| 1363185 | 8/1974 | United Kingdom | 292/241 |

*Primary Examiner*—Eric K. Nicholson

*Attorney, Agent, or Firm*—Lerner, David, Littenberg, Krumholz & Mentlik

[57] ABSTRACT

A locking mechanism for a sash type window comprising two adjacent sashes arranged to slide one behind the other in a generally horizontal direction within an enclosing frame is disclosed. When the window is in its closed position, actuation of the locking mechanism causes the sashes to slide relative to one another in a direction away from each other to assure better sealing between the sashes and the enclosing window frame. In a preferred embodiment, the two sashes are also drawn towards each other in a direction perpendicular to the sliding direction in order to obtain better sealing between the sashes themselves. The locking mechanism may also be used on sliding doors.

9 Claims, 4 Drawing Sheets

LOCKING MECHANISM FOR SLIDING WINDOWS AND DOORS

FIELD OF THE INVENTION

The present invention relates to a locking mechanism for sash type windows comprising two adjacent sashes arranged to slide one behind the other in a generally horizontal direction. The invention is also equally applicable to sliding doors.

BACKGROUND OF THE INVENTION

Sliding windows of the above type are increasing in popularity as their advantages over more conventional swinging windows become apparent. Due to the inherent balance of sliding windows, when they are moved to an open position they remain there, whereas swinging windows need some sort of locating means to maintain the open position. Furthermore, if swinging windows are arranged to open inwardly, the window sills have to be kept clear of objects, such as plants, so that movement of the window is not hindered.

The main disadvantage with sliding windows is the problem of obtaining a satisfactory seal against, particularly, wind and rain. With swinging windows, the problem is not as acute because, when closing windows of this type, the window is pushed against its surrounding frame before being locked in the closed position. Thus, good sealing can be achieved by either ensuring a close fit between the window and frame or by providing a thin layer of insulating material around the frame, or of course, by both measures. With sliding windows, conversely, there is no relative movement of the sashes towards each other and so up until now satisfactory sealing has required high precision in manufacturing and installing such windows so that the sliding elements lie as close to each other as possible.

A further typical disadvantage, particularly with sliding doors, is that several catches or handles have to be operated in order to be able to slide open the doors.

SUMMARY OF THE INVENTION

It is an object of the present invention to provide a locking mechanism for sliding windows or doors of the above-identified type which overcomes the above disadvantages and particularly which provides a better seal when the sliding elements are in their locked position.

This object is achieved according to the present invention by a locking mechanism for a sash type window, or sliding doors, comprising two adjacent sashes arranged to slide one behind the other in a generally horizontal direction within an enclosing frame, and which sashes, in a closed position, have adjacent stiles which are connectable by means of said locking mechanism, said locking mechanism being operable by a handle mounted on a first one of said stiles for actuating an engagement member attached to said first stile to move in a generally vertical plane so as to cooperate in a locking mode with a receiving element mounted on the other stile, wherein said engagement member has a hooked end adapted to cooperate with said receiving element during a locking sequence, which receiving element is in the form of a striker plate accommodated in an insert in the said other stile and provided with a contact surface extending into said insert and diagonally to the plane of operation of said engagement member such that the hooked end of the engagement member can pass into the insert and act on said contact surface to effect relative horizontal sliding between the two stiles during the locking sequence.

Such an arrangement ensures a better seal between the sashes and the enclosing window frame whilst allowing one-handed operation of the locking mechanism via a single handle.

In a preferred embodiment the receiving element has an engaging surface extending across said insert from said contact surface and facing into said insert such that the hooked end of the engagement member, after cooperation with the contact surface, slides into engagement with said engaging surface.

Additionally, the receiving element can be adjustably mounted on its stile. Thus, the degree of relative horizontal sliding between the two slides during the locking sequence can be adjusted.

Advantageously, the engagement member is pivotally mounted between two support webs within a shaped channel made from a rigid material, such as steel, which is fixedly secured to said first stile. Since the engagement member is mounted between two support webs, it is constrained to move in substantially a vertical plane.

In a preferred embodiment, the engagement member is firstly provided with a diagonally extending slot within which a pivot pin affixed to the two support webs passes, and is secondly provided with a pin at its end remote from the hooked end which pin passes through a generally vertical slot in one of said support webs and engages a link piece attached to an actuator rod operable by the handle of the locking mechanism such that during the locking operation, once said hooked end of the engagement member has passed from said contact surface into engagement with said engaging surface, relative horizontal sliding between the two stiles ceases and said stiles are drawn together in a direction perpendicular to the said previous sliding direction. In this way, it is assured that a better seal is obtained between the two stiles since these stiles are drawn together after the end of the locking sequence.

Additionally, the handle of the locking mechanism can also be mounted on said shaped channel.

The locking mechanism may also be provided with blocking means to prevent displacement of the handle from its open position to its closed position when the window is open.

The blocking means advantageously comprises a spring-biased plunger which is depressed by relative movement of the vertical stiles towards each other to effect freeing of the handle mechanism.

DETAILED DESCRIPTION OF A PREFERRED EMBODIMENT

Figure 1:
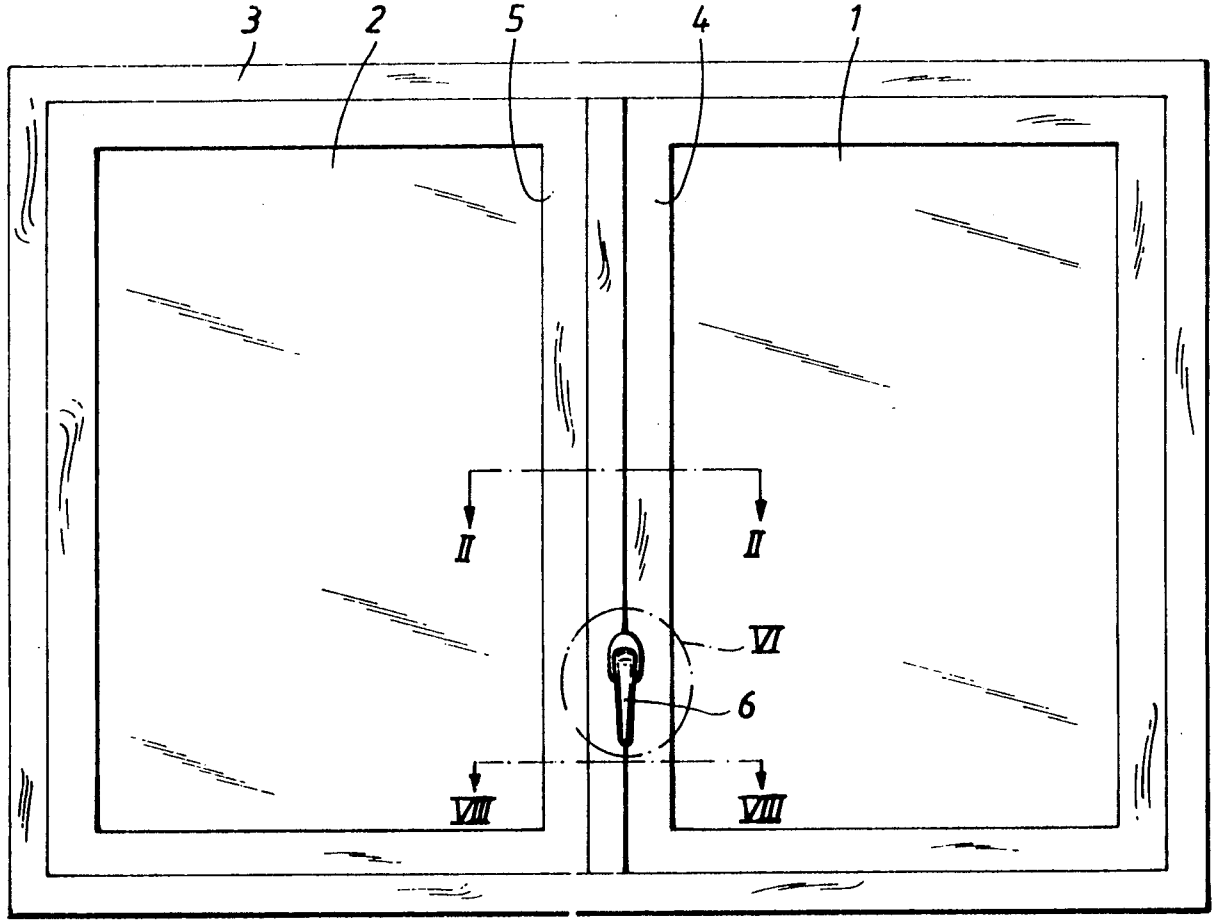
FIG. 1 is a elevational perspective view of a sash type window assembly provided with a locking mechanism according to the present invention.
Figure 2:
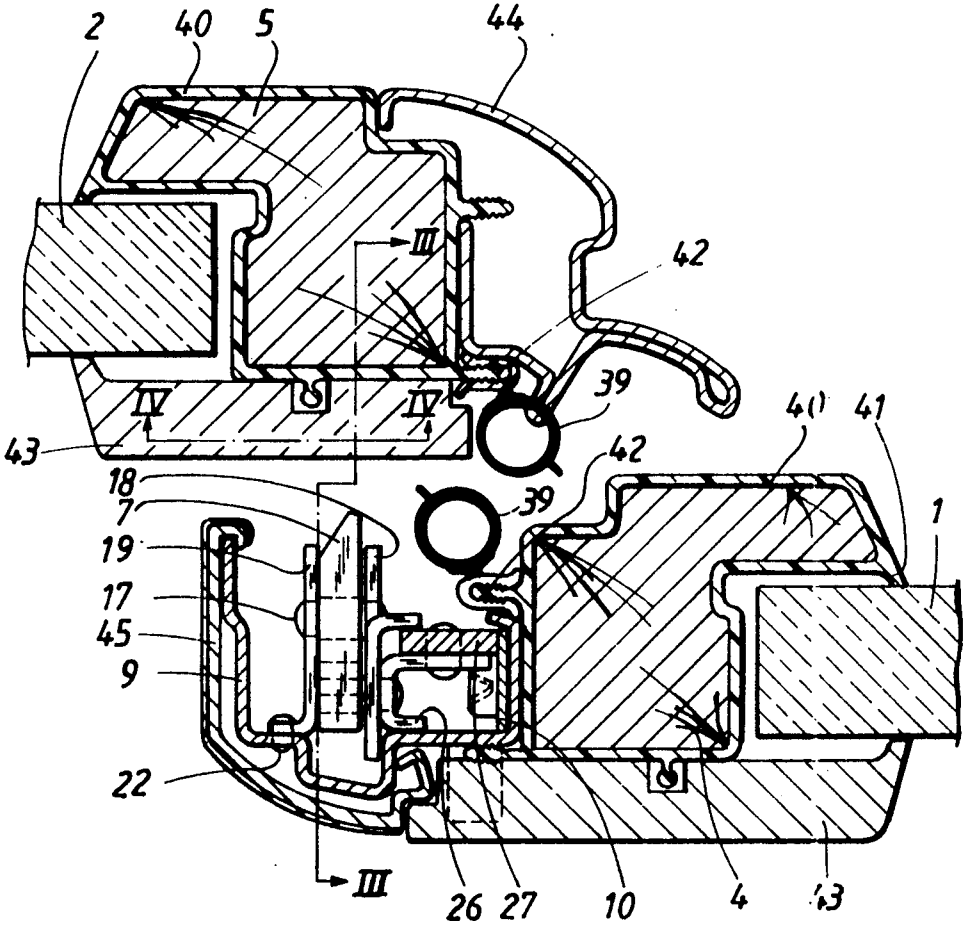
FIG. 2 is a sectional view along line II—II of FIG. 1 showing the relative positions of the adjacent stiles with the windows in a closed position, but before being locked.

A sash-type window assembly is shown in FIG. 1 wherein two sashes 1,2 are accommodated within an enclosing window frame 3. Such a window is normally used in substantially vertical walls of buildings. The assembly is shown in FIG. 1 as seen from the interior of such a building with the sashes in their closed position. In this position, the first and second vertical stiles 4,5 of the sashes 1,2 respectively overlap, as best shown in FIG. 2. The first vertical stile 4 supports a handle 6 which controls the locking mechanism as described in the following.

Figure 3:
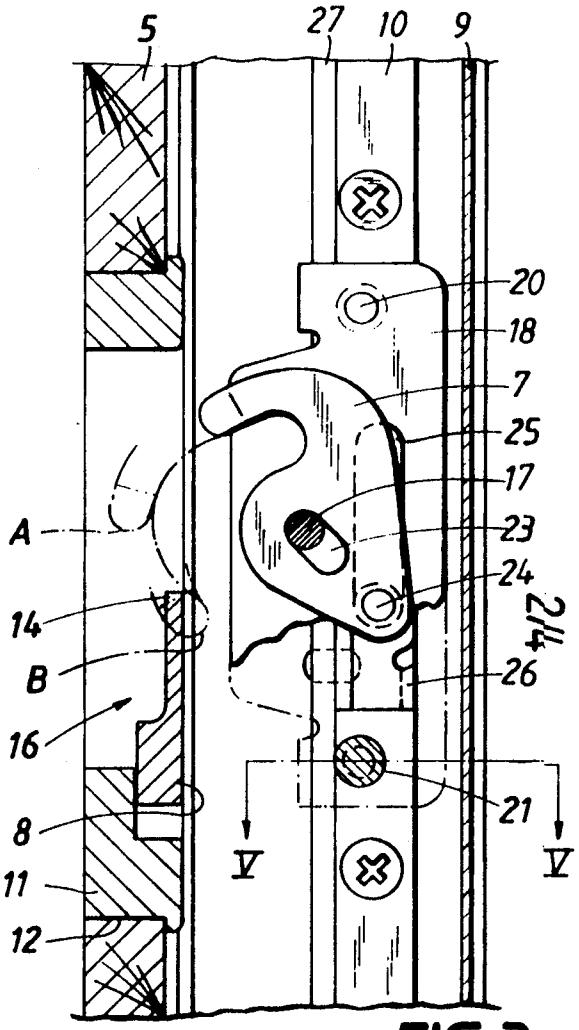
FIG. 3 is a sectional view along line III—III of FIG. 2.

With reference to FIGS. 2 and 3, locking of the window assembly is achieved with the help of cooperating members, an engagement member 7 and a receiving member 8. The engagement member 7 is mounted in a rigid, shaped channel 9 made from steel or any other suitably shape-permanent material The channel 9 is fixedly secured to the first vertical stile 4 by means of a clamping strip 10 running substantially the whole longitudinal length of the stile 4. This clamping strip is attached to the stile by screws or other suitable means.

Figure 4:
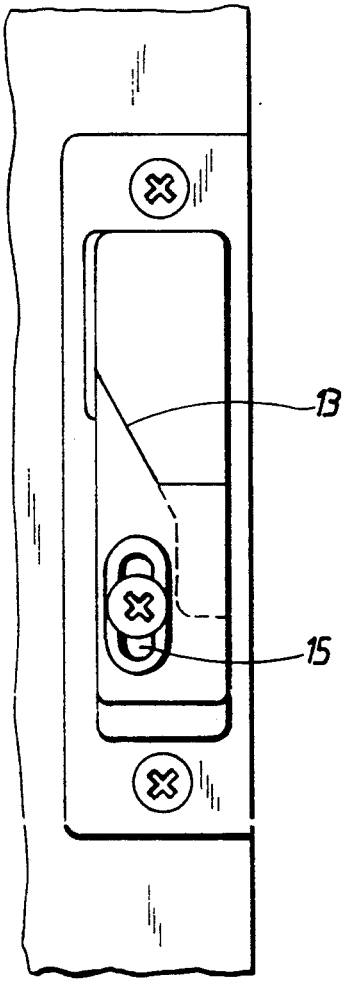
FIG. 4 is a view along line IV—IV of FIG. 2.

As best shown in FIGS. 3 and 4, the receiving member 8 is in the form of a striker-plate which is accommodated in an insert 11 within a recess 12 in the second stile 5. The insert 11, recess 12 and striker-plate 8 are so dimensioned as to allow the engagement member 7 into the recess to act on a contact surface 13 of the striker-plate 8 within the insert 11 and an engaging surface 14 facing into said recess. To achieve such contact, the engagement member 7 has a hook-shaped portion extending from a main body portion as is clearly shown in FIG. 3.

From FIG. 4 it can be seen that the striker-plate 8 itself presents a substantially vertical face which is provided with a vertical slot 15 to allow the plate 8 to be adjusted with respect to the insert 11. The face is in the shape of a polygon with a pair of parallel vertical sides, a pair of parallel horizontal sides and a fifth side which extends diagonally from the upper end of the left-hand vertical side, when viewing the face of the plate as in FIG. 4, to intersect the upper horizontal side approximately half-way along the width of the face. In other words, the plate resembles a square with a right-angled triangle added to the left-hand upper side. An extension of the diagonal side into the recess 12 to substantially the full depth of the recess forms said contact surface 13. Although on the face of the plate 8 the diagonal side terminates at the intersection with the upper horizontal side, the contact surface 13 in fact extends beyond this intersection behind the face, as represented by the dotted line in FIG. 4, for a short distance. Thereafter, the surface 13 terminates with a vertically downward extending section reaching approximately half-way into the insert 11. The upper horizontal side extends only partly into the insert and demarcates a cavity 16 formed by the final diagonal section of the contact surface 13, the vertically extending section thereof, the side and back-walls of the insert and the rear side of the plate's face. This vertical rear face forms said engaging surface 14. The thus formed cavity is adapted to accommodate the hooked end of the engagement member 7 when the locking mechanism is in its locked position.

The engagement member 7 is rotatable about a pivot pin 17, fixed between support webs 18,19. The support web 18 nearest the stile 4 is held in position with the aid of two cylindrical rollers 20,21 passing between the web 18 and the clamping strip 10, one of which being shown in FIG. 5, whilst the other support web 19 is directly attached to the shaped channel 9 via rivets, welding or any other suitable means as indicated by the reference numeral 22 in FIG. 2.

The engagement member 7 is shown in FIG. 3 in solid lines in its open or non-engaged position. A through-opening in the form of a diagonally extending slot 23 is provided in the main body portion of the engagement member 7 to accommodate the pivot pin 17. At its end remote from the hooked portion, the main body portion is provided with a pin 24 which passes through a vertical slot 25 in the support web 18 nearest the stile 4. The end of the pin 24 remote from the engagement member 7 engages a link-piece 26 attached to an actuator rod 27 operable by the handle 6.

Pivot pin 17 is positioned substantially half-way along the longitudinal length of the stile 4 so that forces generated by the action of the engagement member 7 on the receiving element 8 are more or less equally distributed around the sash window assembly. Additional engagement members and receiving elements may also be provided at either end of the stiles. The handle 6, meanwhile, can be positioned off-centre, and in the illustrated embodiment is arranged on the lower region of the stile 4 for easier access.

Figure 6:
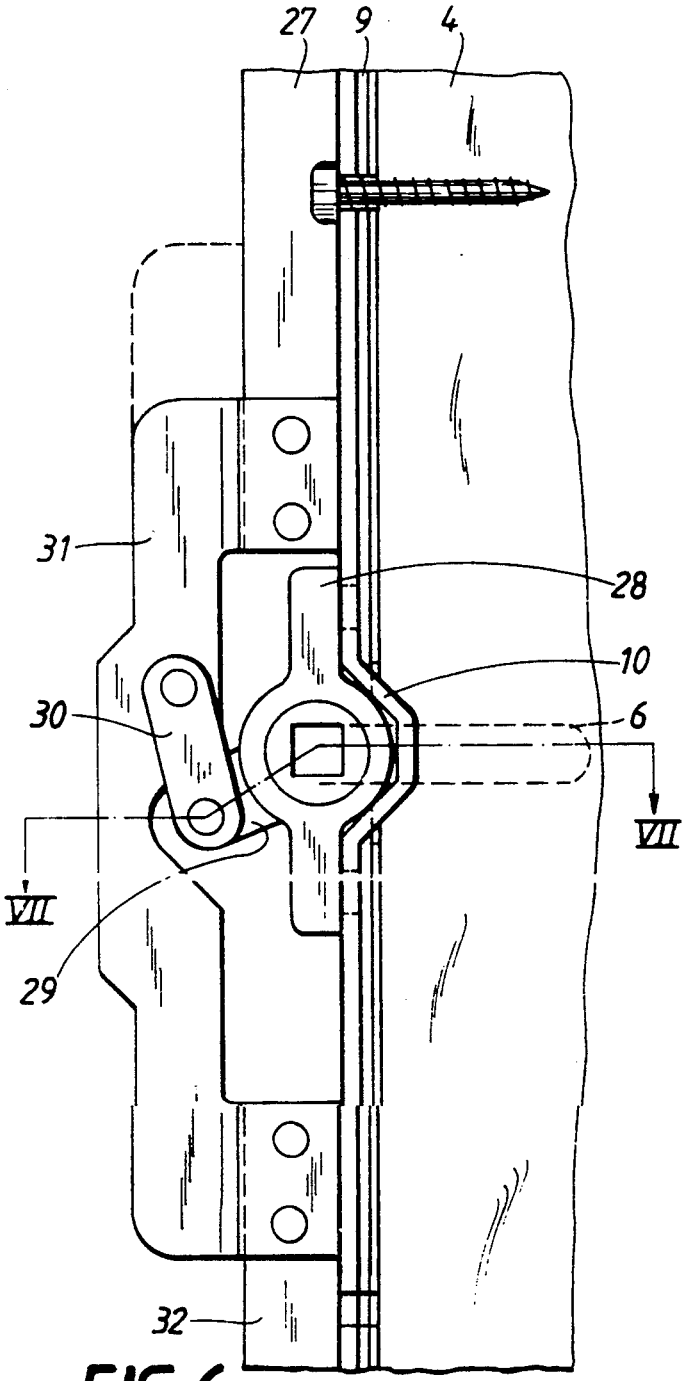
FIG. 6 is a view of the handle arrangement within the shaped channel as indicated in FIG. 1 by VI.
Figure 7:
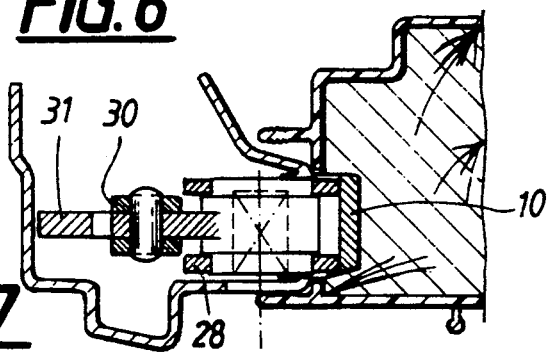
FIG. 7 is a sectional view along line VII—VII of FIG. 6.

The arrangement of the handle mechanism is best understood from FIGS. 6 and 7. Actuator rod 27 is shown in FIG. 6 extending vertically, parallel to the first stile 4. The shaped channel 9 is provided with an opening to allow the clamping strip 10 to protrude into a suitable cut-away in the adjacent stile 4 to form a support for the housing 28 of the handle mechanism. A thrower 29 extends from the handle mechanism and is arranged to rotate about a centre-line passing through the housing 28, along which the handle 6 engages the mechanism. A double pivot link 30, which may have the same length as the thrower, is rotatably connected at one end to the end of the thrower 29 remote from the housing 28. The double pivot link's other end is pivotably attached to a vertically extending connector plate 31, which is so shaped as to transmit its vertical displacement to the actuator rod 27, which is confined to move in a vertical plane parallel to, but slightly set back from, the connector plate 31. The double pivot link 30 and the thrower 29 are arranged such that an over-center action occurs at the limits of the handle's motion. Thus, the handle mechanism can be actuated solely by displacement of the handle 6.

Figure 8:
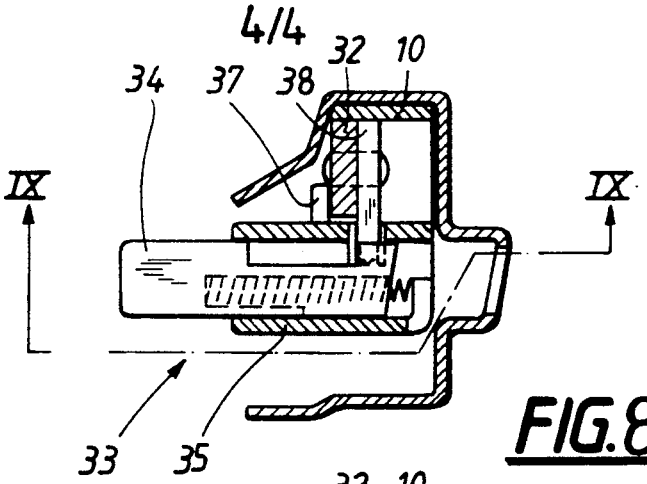
FIG. 8 is a partial sectional view along line VIII—VIII of FIG. 1.
Figure 9:
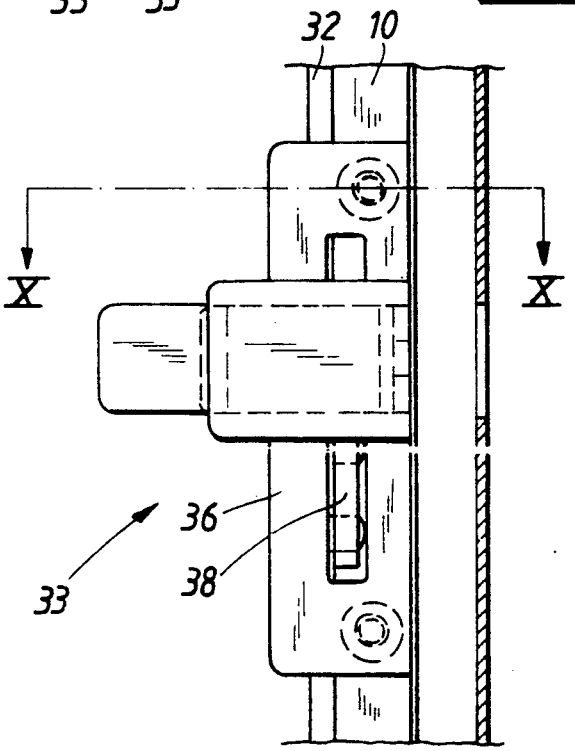
FIG. 9 is a view along line IX—IX of FIG. 8.
Figure 10:
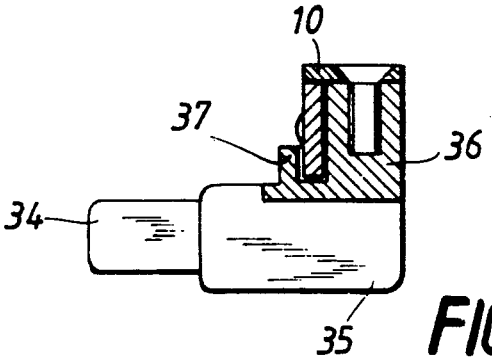
FIG. 10 is a sectional view along line X—X of FIG. 9.

The connector plate 31 is also shown connected to an additional, vertically downwardly extending actuator rod 32. This actuator rod 32 cooperates with one or more blocking devices 33 of the type shown in FIGS. 8 and 9, or controls additional engagement members 7. Similar blocking devices may also be arranged higher up the stile 4. The blocking device 33 comprises a spring-biased plunger 34 extending horizontally from a housing 35. The housing 35 is carried by a support web 36 which is fixedly attached to the clamping strip 10 by screw means or similar (see FIG. 10) at either side of the housing 35, as best seen from FIG. 9. The actuator rod 32, or actuator rod 27 if the blocking device is situated above the handle mechanism, is guided past the blocking device 33 by means of guide projections 37 forming a part of the support web 36. A blocking projection 38 is fixedly attached to the actuator rod 32,27 for cooperation with the spring-biased plunger 34 through an opening in the housing 35.

When the first and second vertical stiles 4,5 are not overlapping, i.e. when the window is open, the plunger 34 projects from its housing 35 due to the action of the spring. In this extended position, any movement of the actuator rod 27 or 32 is prevented by means of the blocking projection 38 abutting a tab on the plunger 34. Thus, when the window is open, the engagement member 7 is maintained in its withdrawn position as shown in FIG. 3. This means that when the sashes 1,2 are being closed, there is no danger that the vertical stile 5 of the sash 2 will impinge against the engagement member 7 which otherwise may have been left in its extended position. To permit operation of the handle 6 once the window has been closed, the plunger 34 is dimensioned such that it is depressed through its contact with the vertical stile 5 as the stiles 4,5 overlap. Depression of the plunger 34 causes the tab thereon to move out of abuttment with the blocking projection 38, thereby freeing the handle mechanism.

The operation of the locking mechanism will now be described with reference to the Figures.

In FIG. 6 the handle mechanism is shown in solid lines in the open position in which the handle 6 is schematically shown by dotted lines lying horizontally. As the window is closed, i.e. as the vertical stiles 4,5 begin to overlap, not shown guide means cause the stiles to move relatively towards each other to the position shown in FIG. 3. This relative movement depresses the plunger 34, thereby freeing the handle mechanism. The handle 6 can now be gradually turned in a clockwise direction through 90° to effect the locking. During this movement, the thrower 29 is made to rotate about the centre-line passing through the housing 28, thereby causing the double pivot link 30 to impart a vertically upward displacement of the actuator rods 27,32.

Figure 5:
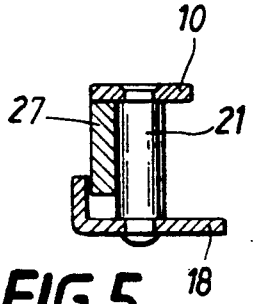
FIG. 5 is a partial sectional view along line V—V of FIG. 3.

With reference to FIGS. 2 and 3, upper actuator rod 27 effects vertical upward displacement of the link piece 26. During its movement, the actuator rod 27 is guided by the cylindrical rollers 20,21 as shown in FIG. 5. Since the pin 24 of the main body portion of the engagement member 7 is attached to the link piece 26, the engagement member 7 is brought to commence rotation about pivot pin 17. Because the pin 24 is guided via the slot 25 in the support web 18, it is constrained to move in solely a vertical plane. Thus, to enable the pin 24 to move vertically upwards, the engagement member slides over the pivot pin 17 due to the degree of freedom permitted by the diagonally extending slot 23 in the main body portion of the engagement member through which the pivot pin 17 passes. Thus, the engagement member 7 is displaced to the left as shown in FIG. 3 and, after a half of the permitted rotation of the handle 6, i.e. 45°, the engagement member has been moved to where its hooked end is in an intermediate position denoted by "A" in FIG. 3 and represented by dotted lines.

In this intermediate position, the hooked end of the engagement member 7 extends into the insert 11 in the recess 12 in the second stile 5 to a position where its tip is above the contact surface 13 of the striker-plate 8 extending into the recess.

Further rotation of the handle 6 causes the actuator rod 27, via link piece 26, to raise the pin 24 on the engagement member 7 so that the tip of the hooked end of the engagement member is brought into contact with the contact surface 13 of the striker-plate 8. Because the pin 24 on the engagement member can only move in a vertical direction, the engagement member is made to slide back along the pivot pin 17 in the slot 23, thereby drawing the tip of the hooked end towards the right as shown in FIG. 3, and which position is designated by "B" and shown in dotted lines.

During the movement from position "A" to position "B", the reaction of the tip of the hooked end with the diagonally extending contact surface 13 generates a force with a horizontal component on the striker-plate 8 and the engagement member 7. Since the engagement member 7 is free to move in only a vertical plane due to its confinement by the support webs 18,19, the generated force creates a relative sideways displacement of the two window sashes 1,2 which tends to push the sashes to the remote ends of the enclosing window frame 3. The degree of displacement can be altered by adjusting the position of the striker-plate 8 on the insert 11 in the recess 12.

As the engagement member 7 approaches the locked position denoted by "B", its tip slides into contact with the vertical engagement surface 14. Since the tip is in fact moving towards the pivot 17 for the engagement member, the engagement surface 14 and hence the stile 5 is drawn towards the stile 4.

From the above, it is clear that the cooperation of the engagement member 7 with the striker-plate 8 brings about a movement of the two stiles 4,5 towards each other and sideways away from each other. Thus, a better seal is possible between the stiles themselves and between the sash frames and the enclosing window frame.

To further improve the insulation of the window assembly, the stiles may be provided with rubber sealing strips 39 as shown in FIG. 2. As is also evident from FIG. 2, the stiles themselves are identical, except that one is inverted by 180° with respect to the other. Both stiles may be covered by a plastic casing 40, which casing is provided with projections 41,42 suitable for locating the glass panes on one side, as well as the said sealing strips respectively To locate the glass panes on the other side, wood stops 43 are also attached to the stiles. It goes without saying that these wood stops 43 are provided with suitable through-holes for the handle and the striker-plate, etc.

On the second stile 5, suitable projections may locate a wind deflector strip 44 whilst the corresponding projections on the first stile 4 are used to help locate the shaped channel 9.

Finally, a finishing strip 45 may be clipped over the shaped channel 9 to improve the appearance of the assembly.

Naturally, the present invention is not restricted to the above-described embodiment, but may be varied within the scope of the appended claims. For example, the locking mechanism need not be actuated by a 90° movement of the handle, but instead by a movement more or less than 90 . Additionally, it may prove advantageous if the tip of the hooked end of the engagement member is rounded or chamfered. Similarly, the projecting end of the plunger 34 may also be provided with a rounded or chamfered surface. Furthermore, the above-described locking mechanism may also be employed on sliding windows which are not mounted vertically, such as sliding skylights. Thus, the terms "vertical" and "horizontal" have been used herein purely to aid definition of planes of reference to help describe the invention and are not to be construed as limiting the invention to any unfair extent.

What is claimed is:

1. A locking mechanism for a window or a sliding door having a frame and a pair of adjacent sashes at least one of which is slidable behind the other with respect to said frame in movement directions, each of said pair of sashes having a meeting rail extending in an elongation direction, said meeting rails adapted to lie adjacent one another when said sashes are in a closed position, said locking mechanism comprising an engagement member connected to one of said meeting rails and moveable in an operating plane transverse to said movement directions, said engagement member having a curved end, a receiving element connected to the other one of said meeting rails, said receiving element having an inclined surface extending oblique to said movement directions and an engagement surface disposed transverse to said operating plane, a handle connected to said one of said meeting rails and moveable between a locked position and an unlocked position, and an operating mechanism including means for moving said curved end of said engagement member into engagement with said inclined surface of said receiving element responsive to movement of said handle from said unlocked position to said locked position, said operating plane, said inclined surface and said engagement surface being arranged so that, upon movement of said handle from said unlocked position to said locked position, said curved end of said engagement member first acts upon said inclined surface to displace said pair of sashes away from one another in opposite movement directions and then acts upon said engagement surface to draw said meeting rails toward one another in directions transverse to said movement directions.

2. The locking mechanism as claimed in claim 1 wherein the connection of said receiving element to the other one of said meeting rails is adjustable in said elongation direction.

3. The locking mechanism as claimed in claim 1, further comprising a rigid channel secured to said one of said meeting rails and a pair of support webs connected within said channel, wherein said engagement member is pivotally mounted between said pair of support webs.

4. The locking mechanism as claimed in claim 3, wherein said engagement member further includes a diagonal guide slot, and said operating mechanism includes a pivot pin fixedly connected between said pair of support webs and extending through said diagonal guide slot, a second guide slot disposed in said elongation direction in one of said support webs, a guide pin connected to an end of said engagement member opposite said curved end and extending through said second guide slot, and actuating means for actuating said engagement member so that, after said curved end of said engagement member has disengaged said inclined surface and has engaged said engagement surface, displacement of said pair of sashes away from one another in opposite movement directions ceases and said meeting rails are drawn toward one another in directions transverse to said movement directions.

5. The locking mechanism as claimed in claim 4 wherein said handle is connected to said rigid channel.

6. The locking mechanism as claimed in claim 4, further comprising blocking means for blocking the movement of said handle from said unlocked position to said locked position when at least one of said sashes is in an open position.

7. The locking mechanism as claimed in claim 6 wherein said blocking means includes a plunger displaceable between an extended position for preventing movement of said handle from said unlocked position to said locked position when at least one of said sashes is in said open position, and a depressed position for releasing said handle for movement from said unlocked position to said locked position when said sashes are in said closed position.

8. A locking mechanism for a window or a sliding door having a frame and a pair of adjacent sashes at least one of which is slidable behind the other with respect to said frame in movement directions, each of said pair of sashes having a meeting rail extending in an elongation direction, said meeting rails adapted to lie adjacent one another when said sashes are in a closed position, said locking mechanism comprising an engagement member connected to one of said meeting rails and moveable in an operating plane transverse to said movement directions, said engagement member having an end, a receiving element connected to the other one of said meeting rails, said receiving element having an inclined surface extending oblique to said movement directions, a handle connected to said one of said meeting rails and moveable between a locked position and an unlocked position, an operating mechanism including means for moving said curved end of said engagement member into engagement with said inclined surface of said receiving element responsive to movement of said handle from said unlocked position to said locked position, said operating plane and said inclined surface of said receiving element being arranged so that, upon engagement of said engagement member with said inclined surface, said end of said engagement member acts upon said inclined surface to displace said pair of sashes away from one another in opposite movement directions, and blocking means for blocking the movement of said handle from said unlocked position to said locked position when at least one of said sashes is in an open position.

9. The locking mechanism as claimed in claim 8 wherein said blocking means includes a plunger displaceable between an extended position for preventing movement of said handle from said unlocked position to said locked position when at least one of said sashes is in said open position, and a depressed position for releasing said handle for movement from said unlocked position to said locked position when said sashes are in said closed position.

* * * * *